US012674636B2

(12) United States Patent
Vitulli

(10) Patent No.: US 12,674,636 B2
(45) Date of Patent: Jul. 7, 2026

(54) GUN MAGAZINE BASE PAD WITH GRIP ENHANCING FEATURES

(71) Applicant: Brandon Vitulli, Thomasville, GA (US)

(72) Inventor: Brandon Vitulli, Thomasville, GA (US)

( * ) Notice: Subject to any disclaimer, the term of this patent is extended or adjusted under 35 U.S.C. 154(b) by 0 days.

(21) Appl. No.: 18/441,431

(22) Filed: Feb. 14, 2024

(65) Prior Publication Data

US 2025/0257961 A1 Aug. 14, 2025

(51) Int. Cl.
*F41A 9/65* (2006.01)
*F41A 35/00* (2006.01)

(52) U.S. Cl.
CPC ..... *F41A 9/65* (2013.01); *F41A 35/00* (2013.01)

(58) Field of Classification Search
CPC ..... F41A 9/71; F41A 9/65
See application file for complete search history.

(56) References Cited

U.S. PATENT DOCUMENTS

D344,780 S * 3/1994 Jenkins ..... D22/108
5,438,783 A * 8/1995 Sniezak ..... F41A 9/65 42/50
D376,187 S * 12/1996 Haber ..... D22/199
D388,858 S * 1/1998 Stahl ..... D22/100
D493,861 S * 8/2004 Rauch ..... D22/108
7,509,767 B2 * 3/2009 Bolen ..... F41A 9/61 89/197
7,797,871 B2 * 9/2010 Bubits ..... F41A 9/71 42/49.01
7,908,780 B2 * 3/2011 Fitzpatrick ..... F41A 9/65 89/33.1
D688,766 S * 8/2013 Fitzpatrick ..... D22/108
8,590,202 B2 * 11/2013 Keng ..... F41C 27/00 42/90
D757,884 S * 5/2016 Kielsmeier ..... D22/108
9,347,720 B2 * 5/2016 Fitzpatrick ..... F41A 9/70
D810,223 S * 2/2018 Kielsmeier ..... D22/108
D812,176 S * 3/2018 Kielsmeier ..... D22/108
D873,371 S * 1/2020 Kielsmeier ..... D22/108
D892,253 S * 8/2020 Kielsmeier ..... D22/108
D898,852 S * 10/2020 Kielsmeier ..... D22/108
11,085,717 B1 * 8/2021 Hillis ..... F41A 9/71
D1,016,955 S * 3/2024 Burris ..... F41A 9/71 D22/108
12,203,719 B1 * 1/2025 Hart ..... F41A 9/70
(Continued)

*Primary Examiner* — Joshua E Freeman
(74) *Attorney, Agent, or Firm* — J. Wiley Horton

(57) ABSTRACT

A magazine base pad having enhanced gripping features. The base pad has a left side, a front, and a right side. A left wall extends upward along the left side, a front wall extends upward along the front, and a right wall extends upward along the right side. An inward sloping surface runs along the left wall and the right wall. An inward sloping surface preferably runs along the front wall as well. The left side opens into a left side notch. The right side opens into a right side notch. Each of these notches includes a plurality of longitudinally oriented ribs. The ribs are preferably a "saw-tooth" design that allows an engaging finger or thumb to move easily upward across the ribs but tends to frictionally engage a finger or thumb when it is moved downward across the ribs. The notches, ribs, and inward sloping surface cooperate to enhance a user's grip on the base pad.

8 Claims, 14 Drawing Sheets

(56) References Cited

U.S. PATENT DOCUMENTS

| | | | | |
|---|---|---|---|---|
| 2002/0029506 | A1* | 3/2002 | Wollmann | F41A 9/71<br>42/50 |
| 2005/0011097 | A1* | 1/2005 | Freed | F41A 9/65<br>42/49.02 |
| 2008/0190003 | A1* | 8/2008 | Bolen | F41A 9/61<br>42/50 |
| 2014/0068992 | A1* | 3/2014 | Keng | F41A 23/04<br>42/94 |
| 2018/0031342 | A1* | 2/2018 | Faifer | F41A 9/71 |
| 2018/0347929 | A1* | 12/2018 | Hsu | F41A 9/71 |
| 2020/0103189 | A1* | 4/2020 | Cass | F41A 9/71 |
| 2021/0231396 | A1* | 7/2021 | Brown | F41A 9/66 |
| 2022/0107148 | A1* | 4/2022 | Fausti | F41A 9/65 |
| 2023/0070228 | A1* | 3/2023 | Kellgren | F41A 9/65 |
| 2023/0266084 | A1* | 8/2023 | Oaks | F41A 9/65<br>42/50 |

* cited by examiner

GUN MAGAZINE BASE PAD WITH GRIP ENHANCING FEATURES

BACKGROUND OF THE INVENTION

1. Field of the Invention

This invention relates to the field of firearms. More specifically, the invention comprises a magazine base pad having grip enhancing features that allow a user to easily install and remove the magazine.

2. Description of the Related Art

The present invention is a base pad assembly suitable for use with a wide variety of firearm magazines. As will be apparent to those knowledgeable in the field, the designs disclosed herein can be modified and adapted in many forms. It is impossible to illustrate all these possibilities. Accordingly, only an exemplary version will be described in detail. This exemplary version is suitable for use with a magazine such as illustrated in FIGS. 1-2.

FIG. 1 provides an exploded view of some prior art magazine components. Tube 12 is a hollow structure designed to contain and feed cartridges to a firearm's firing chamber. Follower 16 translates vertically within the tube. The follower is urged upward by spring 18. In most designs, the follower and spring are fed into the tube through the open bottom of the tube. These internal components are then captured within the tube via the addition of a base.

FIG. 2 shows a well-known design for a base (referred to as a "base pad" in this instance since it has a larger cross-section than the magazine tube and is intended to provide useful gripping features). Tube 12 incorporates a pair of laterally extending flanges 20—only one of which is visible in FIG. 2. Base pad 14 includes a pair of corresponding slots 22. Base pad 14 is attached to the rest of magazine assembly 10 by sliding slots 22 over lateral flanges 20. In this example the base pad is translated in the rearward direction. Front wall 23 eventually slides against the forward wall of tube 12 and arrests the further rearward translation of the base pad with respect to the tube.

At this point the magazine assembly is completed. The follower and spring are captured within the tube by the base pad. Of course, it is advisable to secure the base pad in this position so that it does not inadvertently come loose. Looking still at FIG. 2, plunger 24 is provided on the rear portion of base pad 14. The plunger is depressed during the installation of the base pad. Once the base pad reaches the installed position, the plunger pops up behind the rear wall of the magazine tube. In order to remove the base pad, the user must then depress the plunger.

The present inventor has recently created a base pad having a much lower overall height than was present in the prior art. This base pad design is described in detail in commonly-owned U.S. patent application Ser. No. 18/143,822—which is hereby incorporated by reference. The reduced height for the base pad has operational advantages, in that it significantly reduces the overall height of the magazine assembly. However, the use of a much slimmer base pad also means that there is less surface area for the user to grip. It is important for the user to be able to securely grip the base pad when installing or removing a magazine assembly. The present invention provides enhanced gripping features for the inventive base pad. The inventive features can be applied to taller base pads as well.

BRIEF SUMMARY OF THE PRESENT INVENTION

The present invention comprises a magazine base pad having enhanced gripping features. The base pad has a left side, a front, and a right side. A left wall extends upward along the left side, a front wall extends upward along the front, and a right wall extends upward along the right side. An inward sloping surface runs along the left wall and the right wall. An inward sloping surface preferably runs along the front wall as well.

The left side opens into a left side notch. The right side opens into a right side notch. Each of these notches includes a plurality of longitudinally oriented ribs. The ribs are preferably a "sawtooth" design that allows an engaging finger or thumb to move easily upward across the ribs but tends to frictionally engage a finger or thumb when it is moved downward across the ribs. The notches, ribs, and inward sloping surface cooperate to enhance a user's grip on the base pad.

REFERENCE NUMERALS IN THE DRAWINGS

Figure 1:
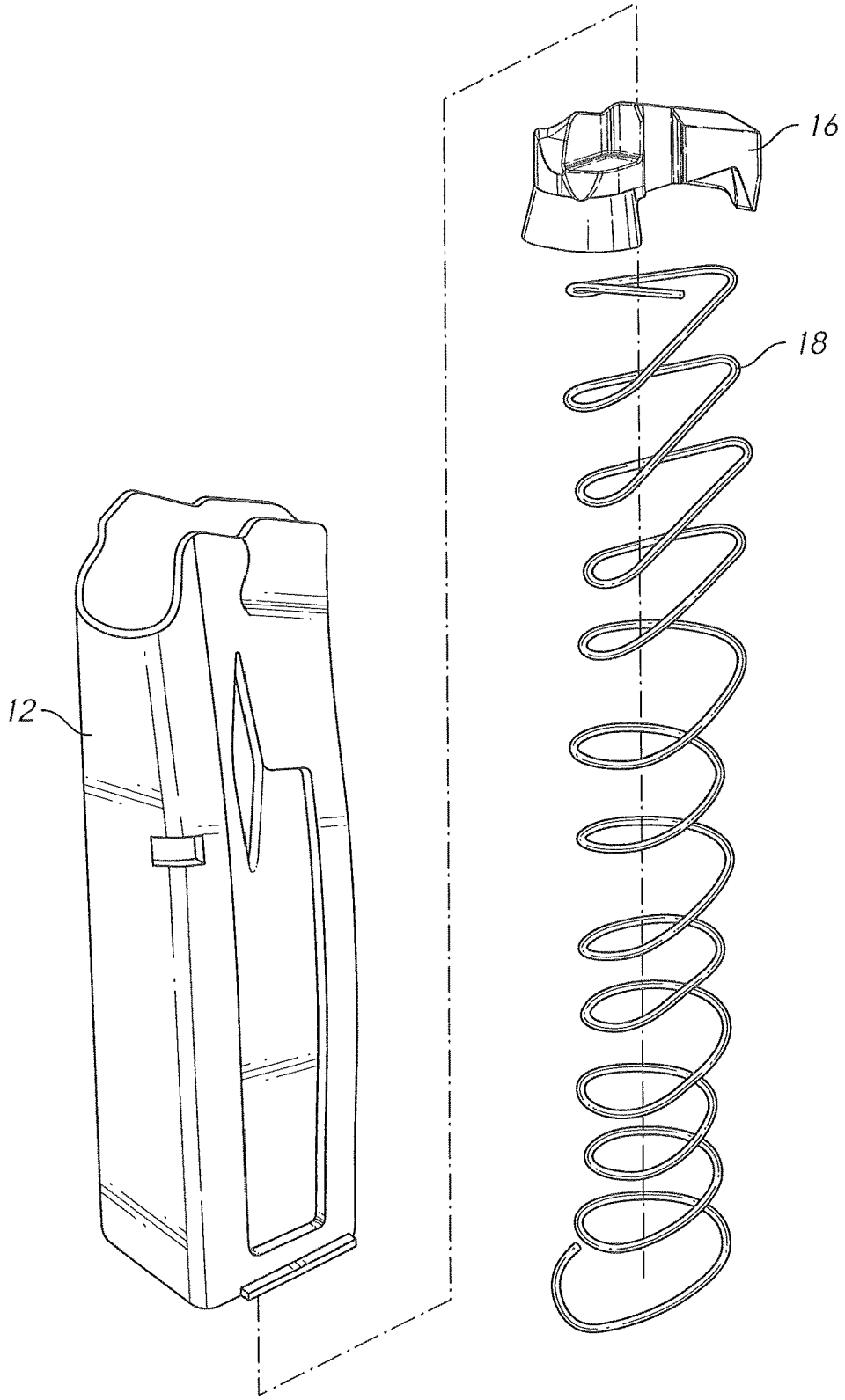
FIG. 1 (Prior Art)
FIG. 1 is an exploded perspective view, showing the tube, follower, and magazine spring of a prior art gun magazine.
Figure 2:
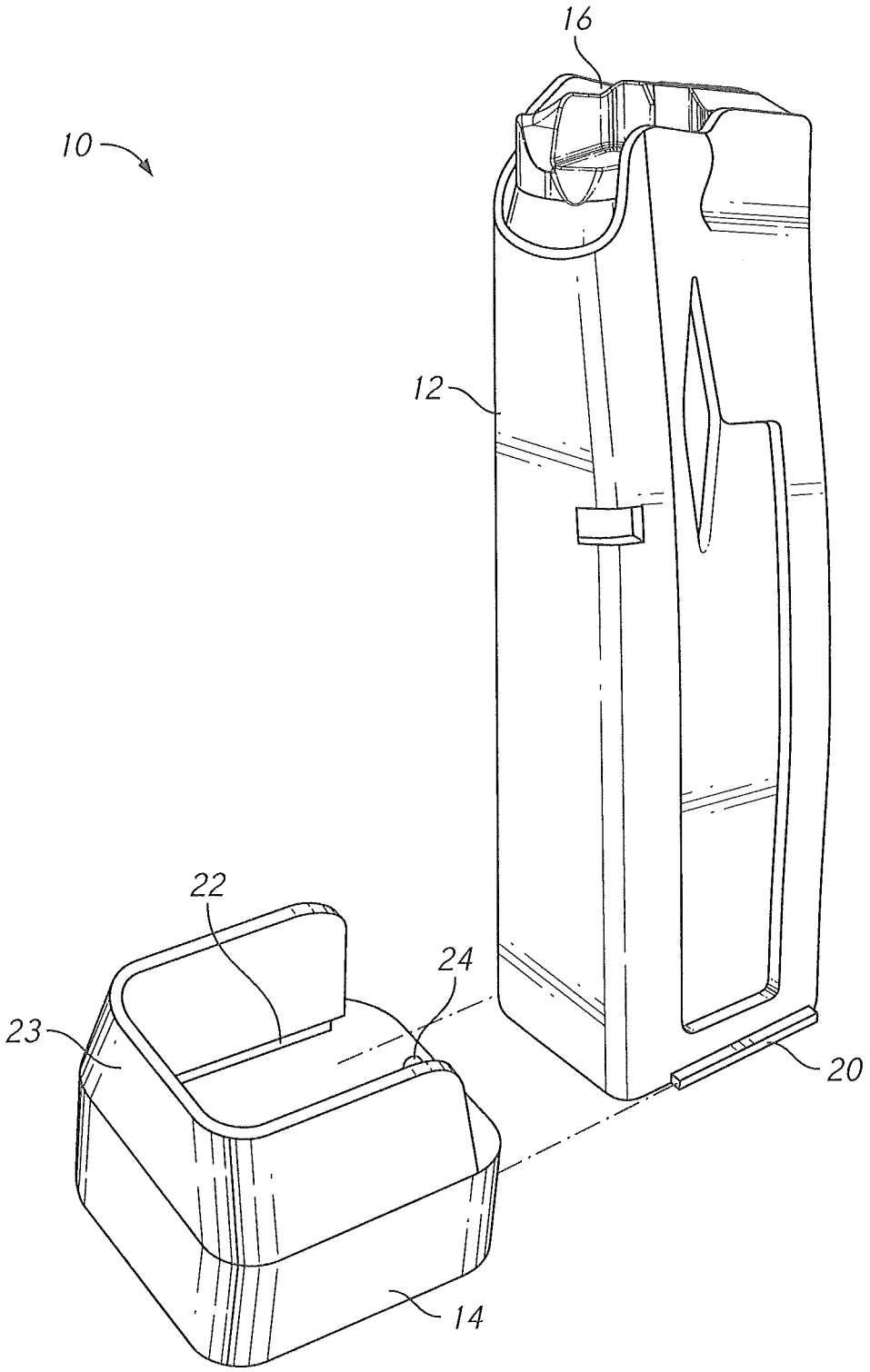
FIG. 2 (Prior Art)
FIG. 2 is an exploded perspective view, showing the addition of a base pad to the assembly of FIG. 2.

10 magazine assembly
12 tube

14 base pad
16 follower
18 spring
20 lateral flange
22 slot
23 front wall
24 plunger
31 floor surface
46 base pad
47 body
48 plunger
50 slot
66 pistol
68 frame
70 slide
72 slide latch
74 right hand
76 right thumb
78 left hand
80 grip
82 left thumb
84 left side
86 front
88 left side notch
90 left wall
92 front wall
94 right wall
96 inward sloping surface
98 forward relief
100 rib
102 tip
104 upper flat surface
106 lower sloped surface
108 right side notch
110 rib
112 finger
114 index finger
116 pouch
118 lower surface

DETAILED DESCRIPTION OF THE INVENTION

The following descriptions pertain to preferred embodiments of the present invention. The inventive elements are found in a base pad that is designed to mount on a magazine tube. Those skilled in the art will know that an endless variety of tube magazines exist. The inventive base pad can be configured to mount on most if not all of these prior art magazines. This detailed disclosure pertains to one magazine type, but those skilled in the art will readily perceive how the disclosed embodiment can be adapted for use with other magazine types.

Figure 3:
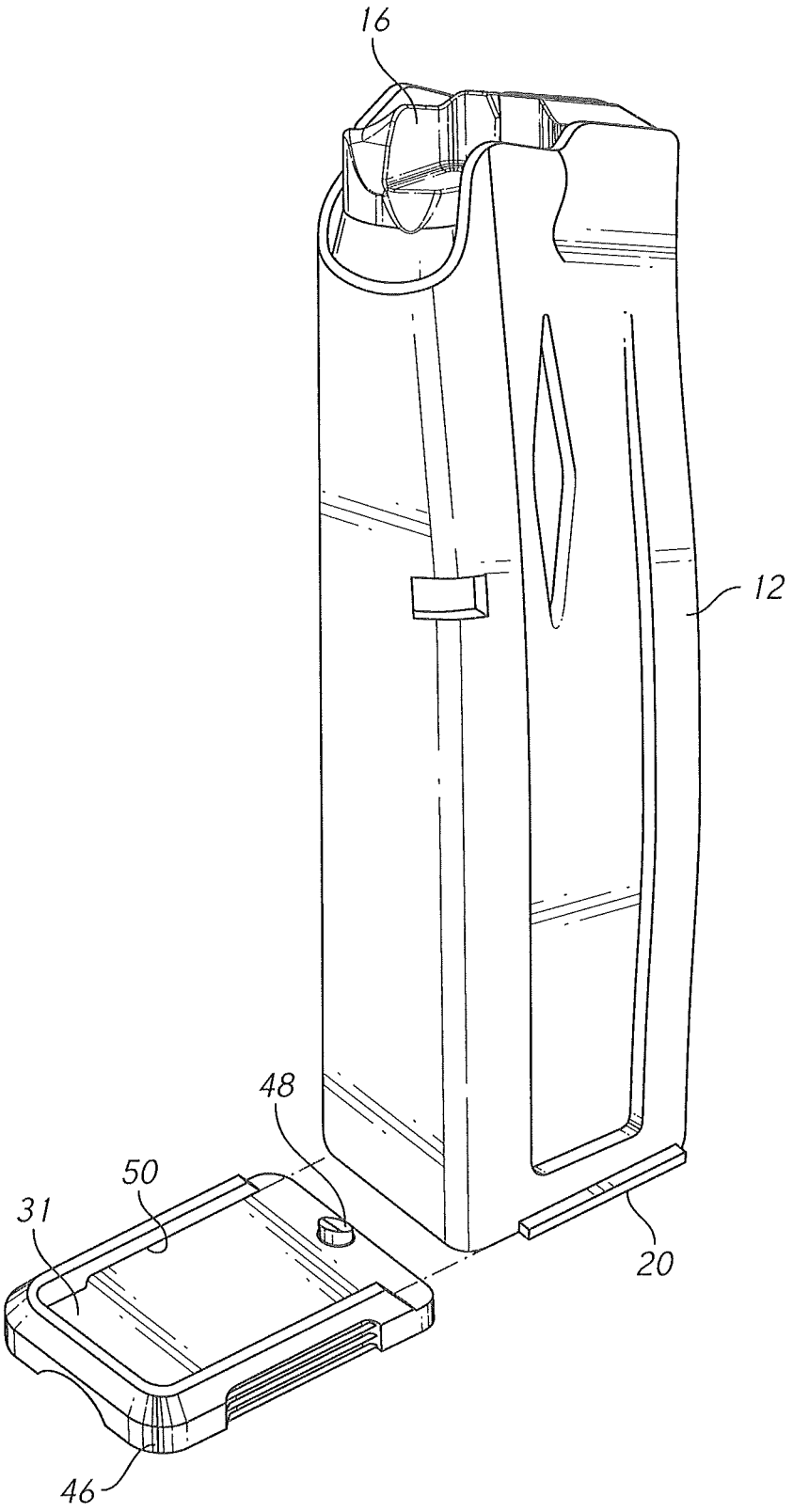
FIG. 3 is an exploded perspective view, showing the addition of the inventive base pad to a magazine assembly.

FIG. 3 provides an exploded perspective view with the inventive base pad 46. Tube 12 includes a pair of lateral flanges 20. The left lateral flange is visible in FIG. 3; the right lateral flange is hidden, but it is a mirror of the one shown. Base pad 46 includes a pair of slots 50 (only one is visible). Slots 50 are sized to slide over lateral flanges 20 when base pad 46 is installed on the bottom of tube 12. Floor surface 31 closes the open bottom of the magazine tube.

Figure 4:
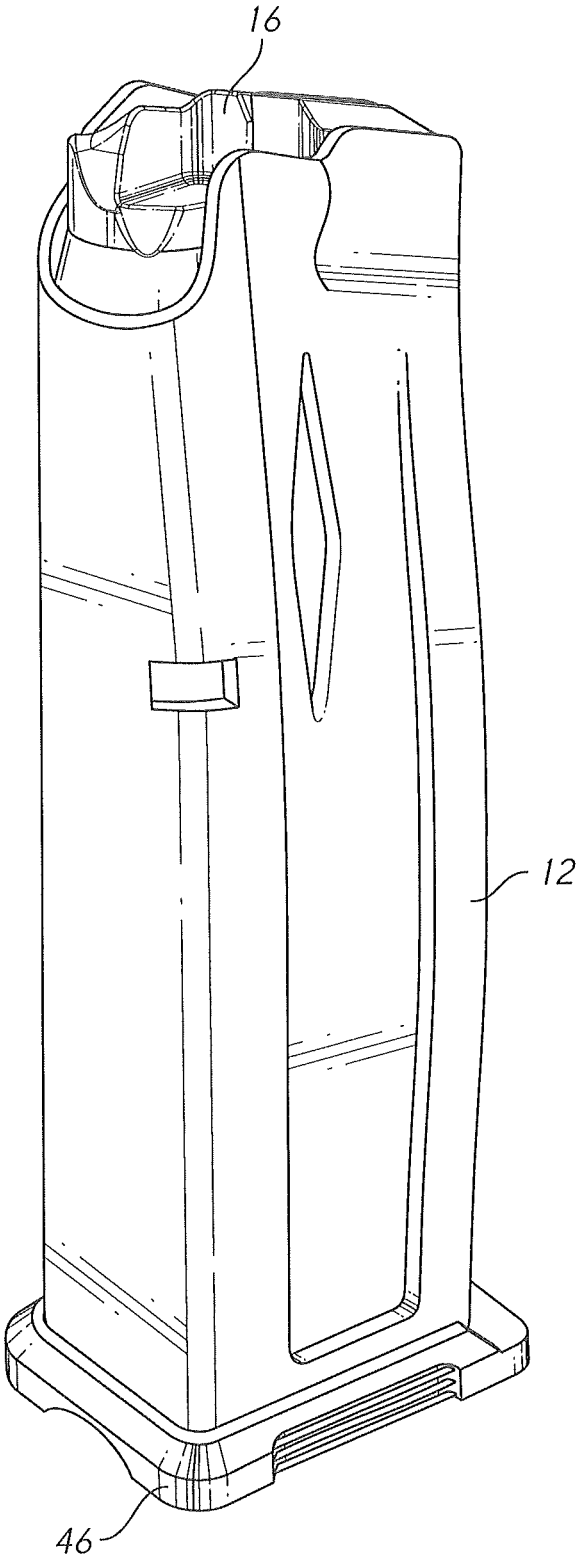
FIG. 4 is a perspective view, showing the assembly of FIG. 3 in an assembled state.

Plunger 48 is depressed to allow the base pad to slide into its installed position. The plunger pops up into the extended position shown once it passes to the rear of the magazine tube's rear wall. The extended plunger then holds the base pad in the installed position as for the prior art. FIG. 4 shows base pad 46 in its installed position on tube 12.

Figure 5:
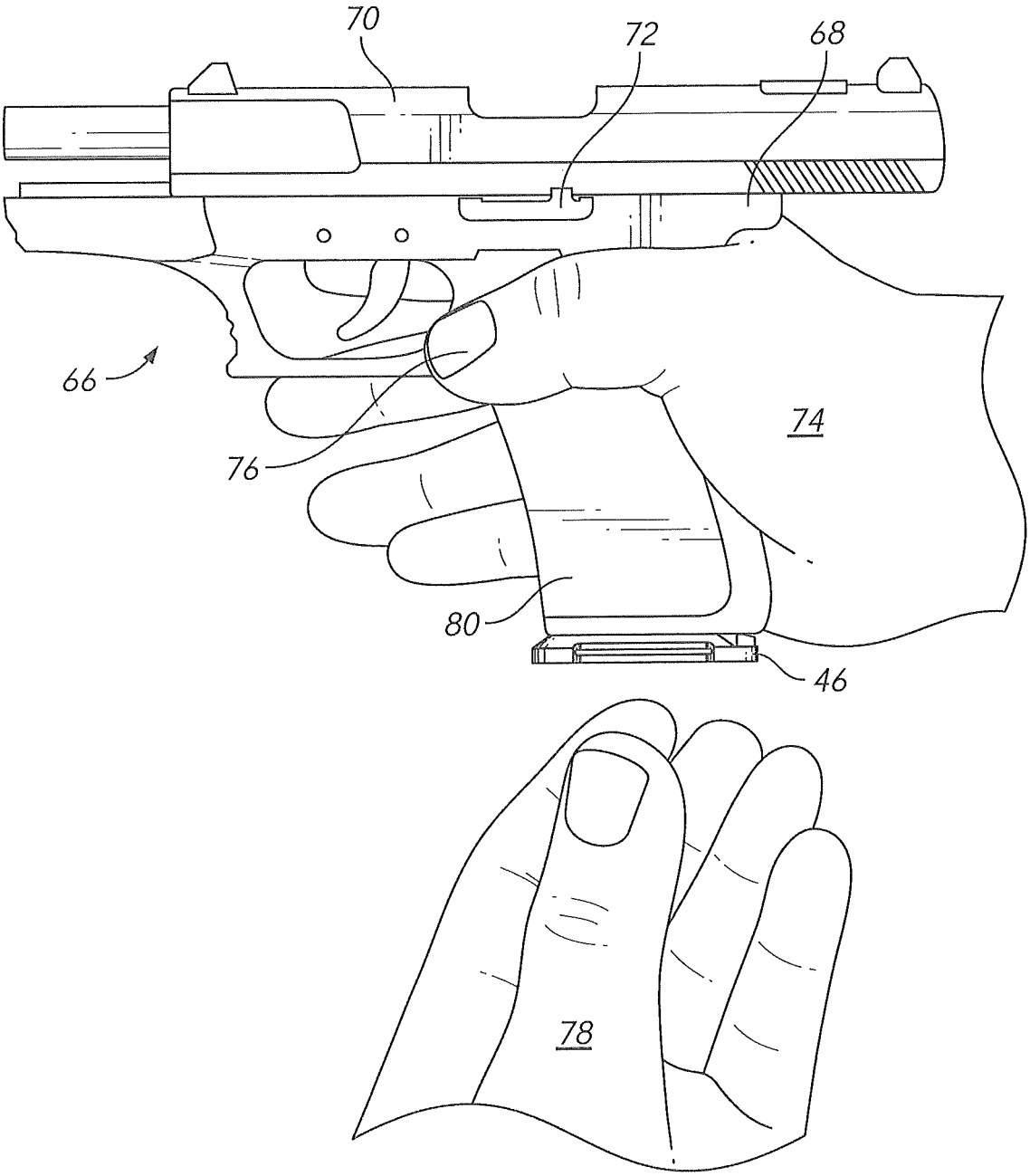
FIG. 5 is an elevation view, showing a user preparing to remove a magazine containing the inventive base pad.

In order to understand the advantages offered by the inventive base pad, it is important to consider how a magazine is usually gripped by the user while it is being installed or removed. FIG. 5 shows a typical prior art pistol 66. As those skilled in the art will know, slide 70 cycles rearward and forward along rails provided on frame 68. Following the firing of the last round in the magazine, slide 70 is locked in the open position via slide latch 72.

Base pad 46 is installed on the bottom of the magazine. The magazine tube is housed within a magazine receiver inside of grip 80 (which is typically part of frame 68). Right hand 74 encircles grip 80. Right thumb 76 actuates a magazine release on the side of the grip (The magazine release is not visible in the view but it lies directly beneath the right thumb). Left hand 78 reaches upward to receive the magazine.

Most magazines are designed so that the follower is pushed somewhat downward in the magazine tube and the magazine spring remains somewhat compressed when the last round is fired and the slide locks back as shown in FIG. 5. Then—when the magazine release is actuated—the magazine "pops" downward under the influence of the magazine spring. The downward force on the magazine is often modest, however, and in many cases removal still depends on the user grasping the base pad and pulling downward.

Figure 6:
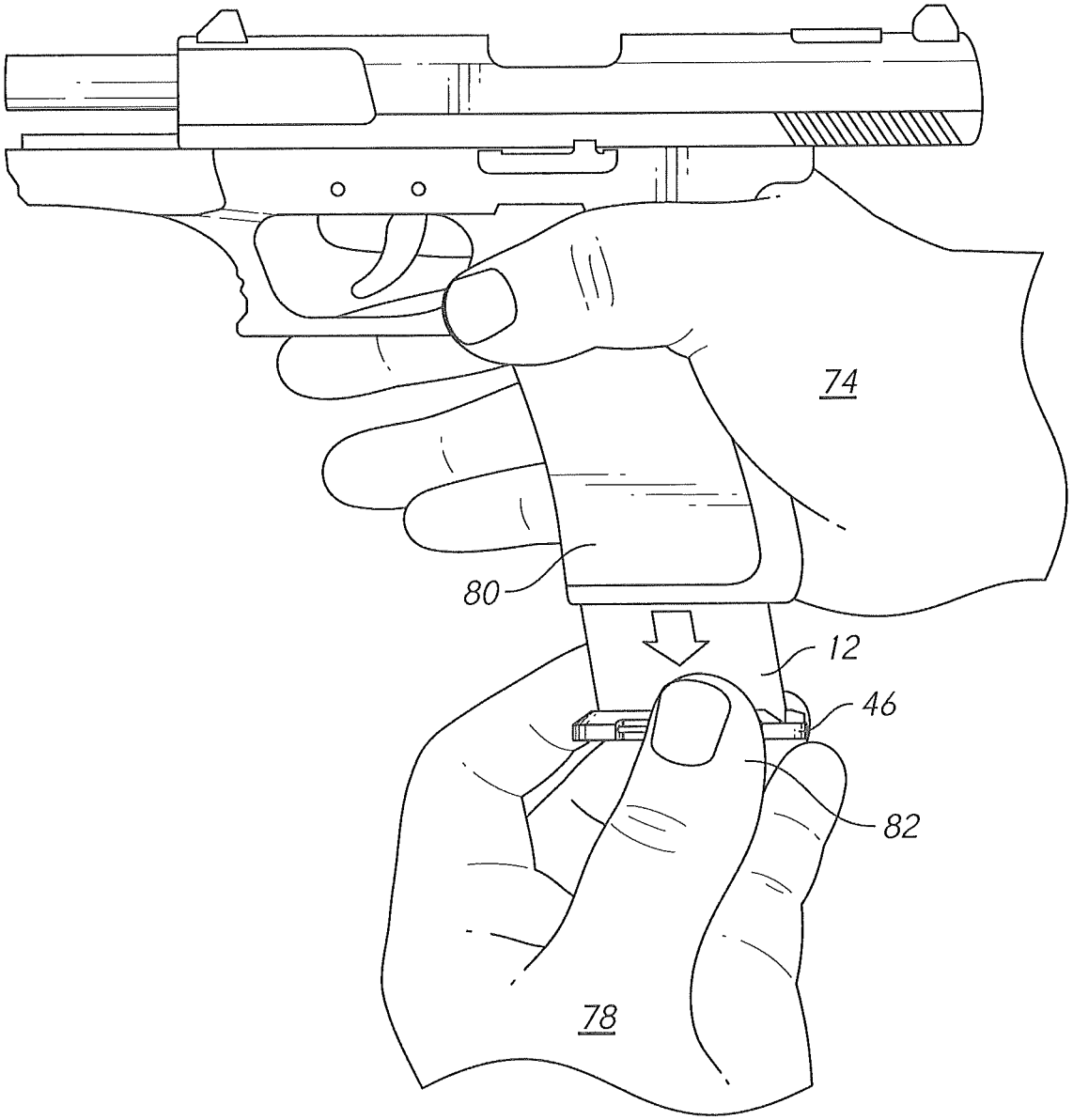
FIG. 6 is an elevation view, showing a user removing the magazine of FIG. 6.

FIG. 6 shows the magazine removal process after the user has grasped the base pad. Right hand 74 continues to hold grip 80. Left thumb 82 has gripped the left side of base pad 46. The fingers of the left hand have gripped the right side of the base pad. The fingers and thumb of the left hand are squeezed together in order to grip the base pad and pull it downward as indicated by the arrow.

The actions shown in FIGS. 5 and 6 are those executed by a right-handed shooter. The actions are a mirror image for a left-handed shooter. Some pistols have an ambidextrous magazine release but many do not. When a magazine release is only provided on the left side of the frame, a left-handed shooter often actuates the release with one of the fingers of the left hand. The base pad is then squeezed between the thumb and the fingers of the right hand and pulled downward.

Base pad 46 is usually the only part of the magazine that extends below grip 80 with the magazine in the installed position, so it is naturally the portion of the magazine that is first gripped by the user. A base pad made according to the incorporated U.S. patent application Ser. No. 18/143,822 has a significantly reduced overall height. This reduced height has obvious advantages, but it also presents a challenge when the user needs to grip the base pad. The present invention provides additional gripping features in the base pad.

Figure 7:
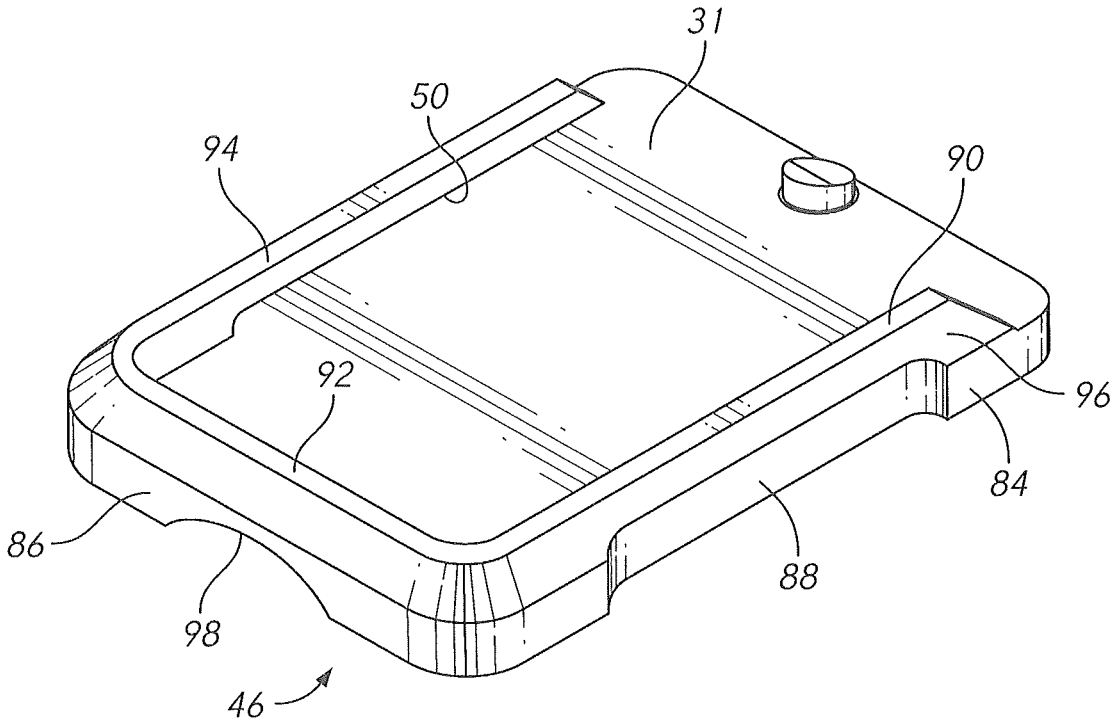
FIG. 7 is a perspective view, showing an embodiment of the present invention.

FIG. 7 shows a detailed perspective view of the inventive base pad 46. It is generally rectangular in this example. Floor surface 31 faces upward when the base pad is installed on the bottom of the magazine tube. Left wall 90 extends upward from floor surface 31 along left side 84 of the base pad. Front wall 92 extends upward from front 86. Right wall 94 extends upward from the right side of the base pad. In the example shown, the walls 90,92,94 are joined together into one continuous wall. A curved intersection (a fillet) is provided at the two front corners so that the walls are blended smoothly.

An inward sloping surface 96 is provided on each of the walls 90,92,94. In this context the term "inward" means that the surface slopes inward toward the center of the magazine when proceeding from bottom to top—resulting in the walls 90,92,94 becoming thinner when proceeding from bottom to top. Left side notch 88 is provided in the left side 84 of the base pad. In the example shown this left side notch extends into left wall 90 and inward sloping surface 96. A right side notch is provided on the right side of the base pad that is a mirror of left side notch 88.

Forward relief is provided in the bottom and forward sides of the base pad. Gun magazines are often stored in an inverted position in equipment vests and the like. Forward relief provides a locating "notch" for the index finger when the thumb and second finger are used to grip the base pad of an inverted magazine and pull it free of a pouch.

The side notches likewise provide good locating notches for the thumb of one hand and the fingers of the other hand. This is true whether the base pad is upright as shown (such as would be the case when mounted on a magazine tube and installed in a firearm) or inverted (such as would be the case when mounted on a magazine tube and stored inverted in an equipment vest). Thus, the reader will perceive that the left side notch, the corresponding right side notch, and forward relief 98 cooperate to positively locate the user's thumb, first finger, and second finger.

Figure 8:
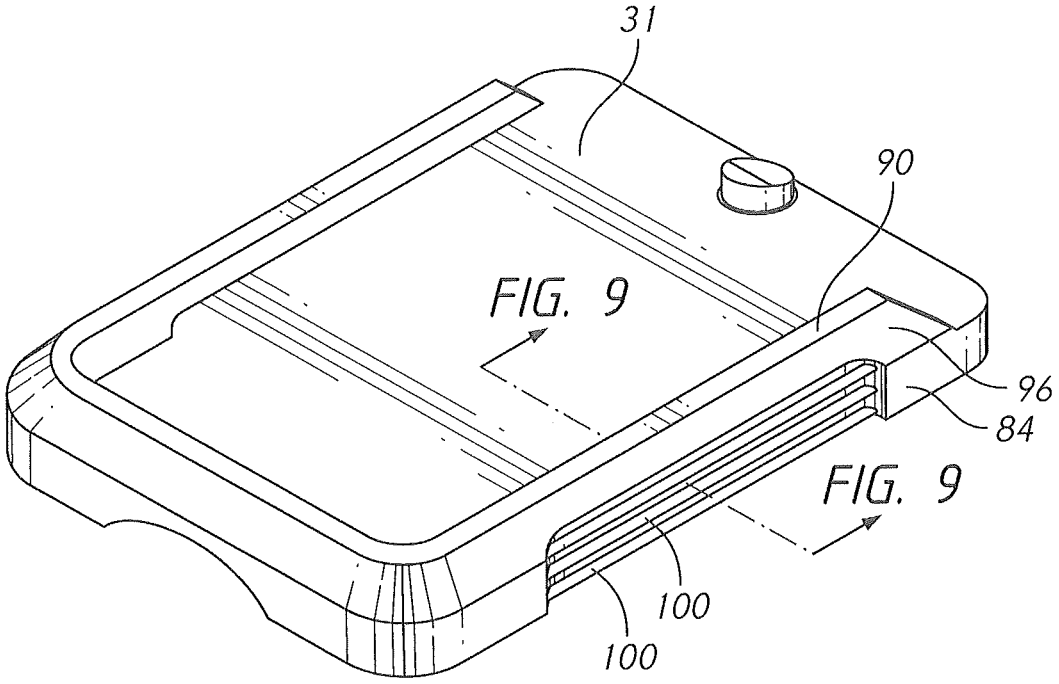
FIG. 8 is a perspective view, showing an embodiment of the present invention.

It is desirable to provide additional grip-enhancing features-particular on the left side and right side. FIG. 8 shows an embodiment including these grip enhancing features. A plurality of longitudinal ribs 100 are provided in the left notch of the base pad. The term "longitudinal" means that the ribs are oriented to be approximately parallel to the bore of the firearm when the base pad is installed on a magazine tube and the magazine tube is installed in the firearm. "Approximately" means within 30 degrees of perfectly parallel.

A second plurality of longitudinal ribs 100 is provided within the right-side notch (not visible in FIG. 8). In looking at FIG. 8, the reader will note a section view "callout" for a section plane depicted in FIG. 9.

Figure 9:
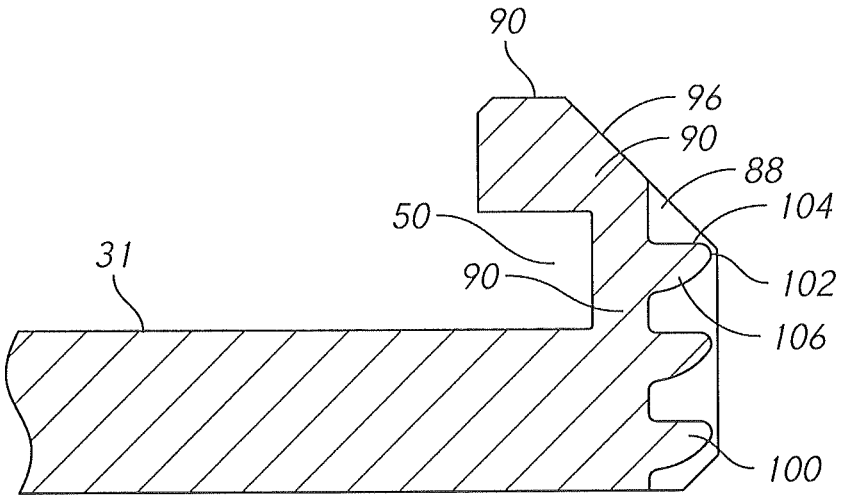
FIG. 9 is a sectional elevation view, showing the longitudinal ribs used in an embodiment of the present invention.

FIG. 9 provides a sectional elevation view through the plurality of longitudinal ribs 100 on the left side of the base pad. The reader will note again how left side notch 88 extends into left wall 90 and inward sloping surface 96. The cross-sectional shape of the ribs is significant to the invention. The ribs are given a "sawtooth" shape so that they will provide enhanced grip in the direction where enhanced grip is needed-pulling the magazine in the base pad-first direction. This is the direction needed when pulling a magazine downward out of a firearm or upward out of a storage pouch.

Each rib 100 is provided with an upper flat surface 104 and a lower sloped surface 106. Each lower sloped surface slopes inward when proceeding from a rib's upper flat surface toward the bottom of the base pad. The combination of surfaces 104,106 provides the sawtooth shape. This creates less frictional engagement when swiping a thumb or finger upward along the ribs in the orientation shown in the view of FIG. 9, and greater frictional engagement when swiping downward. Tip 102 is preferably provided with a small fillet radius so that the tip is not unduly sharp.

Figure 10:
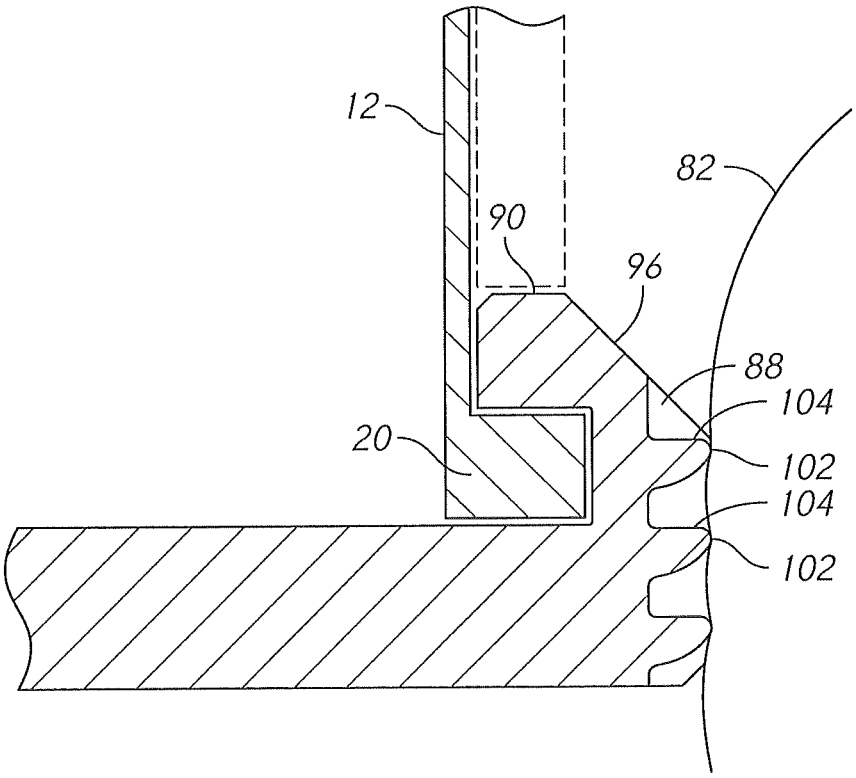
FIG. 10 is a sectional elevation view, showing the longitudinal ribs used in an embodiment of the present invention.

FIG. 10 shows a sectional elevation view through the base pad as it sits installed on a magazine. The magazine is installed in the grip portion of a pistol frame—with the frame being shown in dashed lines. A right-handed user is preparing to remove the magazine. Accordingly, left thumb 82 is pressed into left side notch 88 and against longitudinal ribs 100. The reader will note how the sawtooth shape of the plurality of ribs creates an enhanced frictional engagement with the user's thumb when the thumb presses inward and pulls downward on the base pad.

Figure 11:
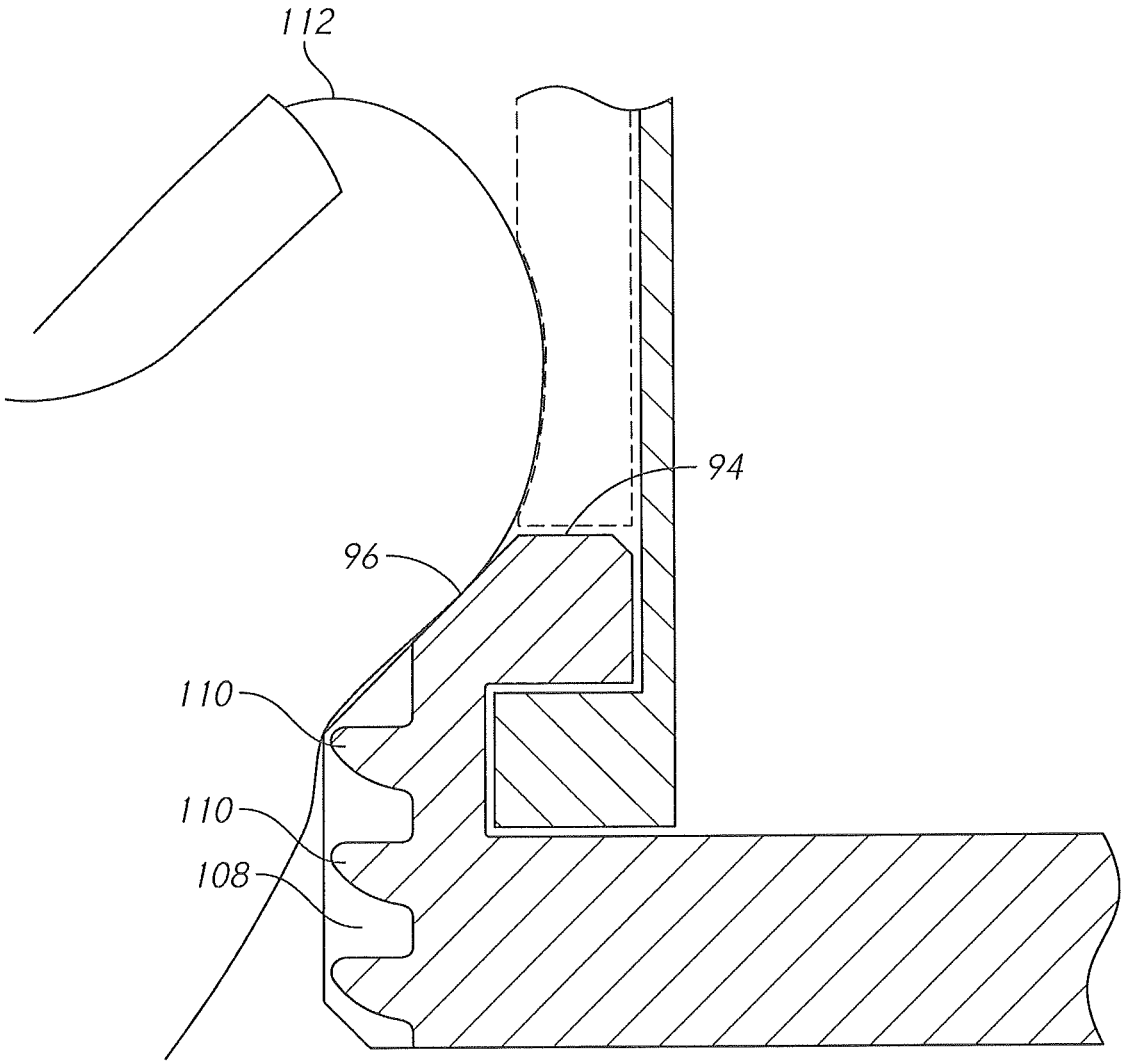
FIG. 11 is a sectional elevation view, showing the inward sloping surface used in an embodiment of the present invention.

FIG. 11 shows a sectional elevation view taken through the opposite (right) side of the base pad in the same plane as that used in FIG. 10. The reader will note that right side notch 108 on the right side of the base pad is provided with a second plurality of longitudinal ribs 110. These ribs are engaged by the tip of finger 112. However, the reader will also note that finger 112 bears more against inward sloping surface 96 of right wall 94 than against the longitudinal ribs. This is the result of the angles the thumb and fingers assume when grasping a base pad to remove a magazine from a firearm.

Figure 12:
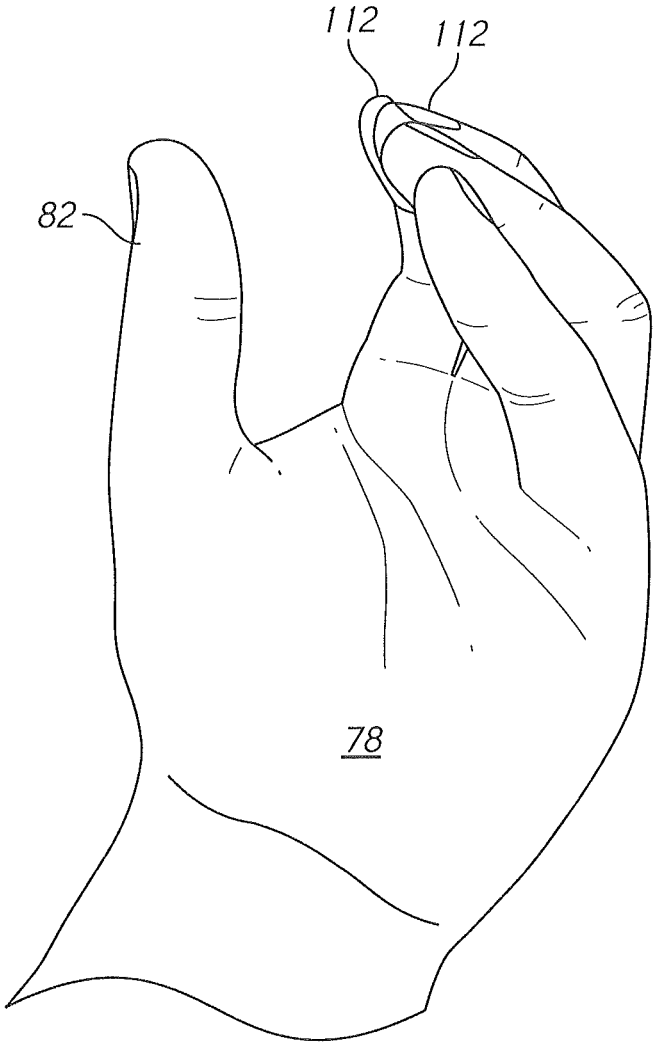
FIG. 12 is a perspective view, showing the pose of the left hand when preparing to grasp the base pad of a magazine.

FIG. 12 shows the pose of left hand 78 in reaching to grasp a magazine base pad-looking from the rear of the pistol forward. The reader will recall that—in the case of a right-handed shooter—the right hand controls the pistol and the left hand reaches for the magazine. The pose shown is natural for the left hand. Left thumb 82 is approximately vertical. Fingers 112 curl inward so that the fingertips are angled significantly inward from the vertical. Looking now at FIG. 11 (which is looking from the front toward the rear), the pose of the hand explains why finger 112 engages the base pad at the angle shown. Inward sloping surface 96 provides a good gripping surface for the fingers. Ribs 110 on the right side of the base pad provide additional grip as well.

Given the hand pose characteristics, one might naturally provide the longitudinal ribs on the "thumb side" of the base pad and the inward sloping surface on the "finger side." However, one must remember that there are left-handed shooters as well as right-handed shooters. For a left-handed shooter, the pose shown in FIG. 12 will be reversed. Accordingly, it is preferable to provide a plurality of longitudinal ribs on both sides of the base pad and an inward sloping surface on both sides of the base pad.

Figure 15:
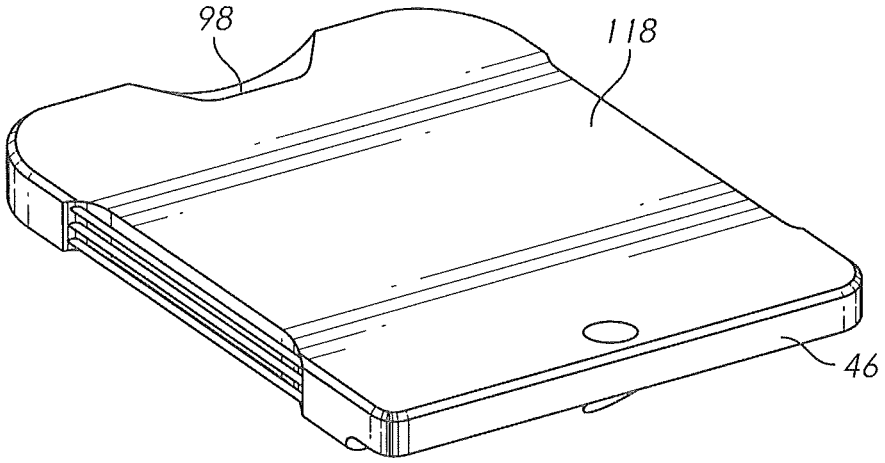
FIG. 15 is a perspective view, showing the lower surface of the base pad and the forward relief in more detail.

FIG. 15 shows a view of the base pad in an inverted orientation. Lower surface 118 is readily visible. The shape of this particular embodiment of forward relief 98 can be easily visualized in this view. As mentioned previously, forward relief 98 serves to orient the user's hand when grasping the base pad. This orienting feature can be helpful in several circumstances-some of which are described in the following.

As those skilled in the art will know, a user on some occasions needs to rapidly grasp and extract a magazine (either from the pistol itself or an external storage pouch) without stopping to look at the magazine. As an example, when a law enforcement officer is engaging a target, he or she does not wish to look away from the target in order to reload. In the reloading cycle, the officer must grasp and remove the expended magazine-preferably without having to look. The officer must also extract a new magazine from a storage pouch, orient it correctly, and insert it into the firearm.

Figure 14:
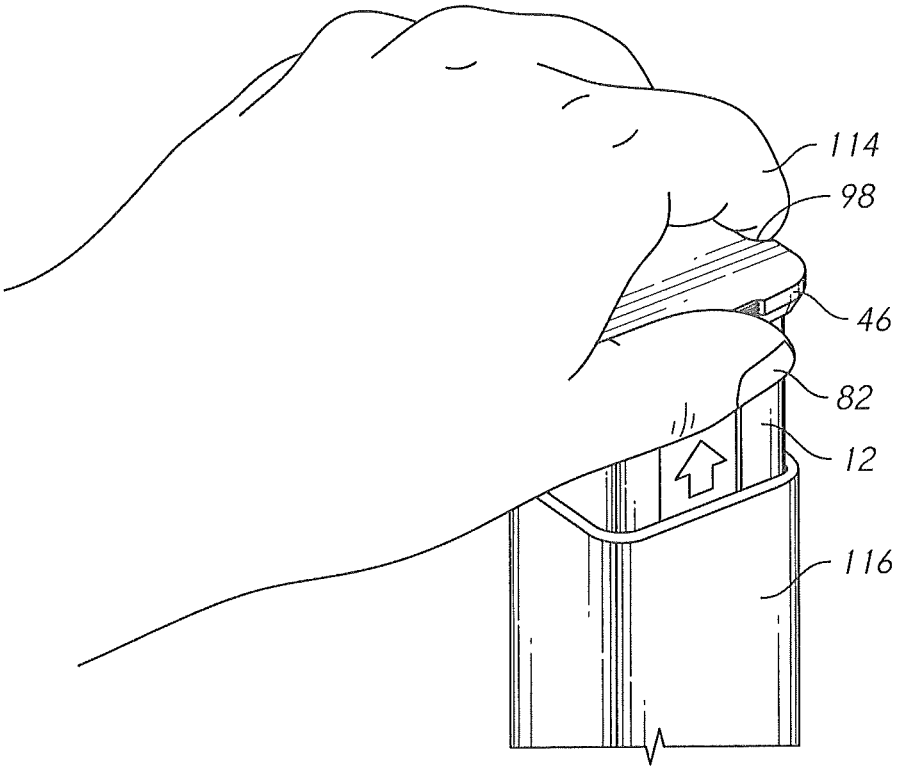
FIG. 14 is a perspective view showing the extraction of a magazine assembly from a pouch.

FIG. 14 shows the scenario of a magazine assembly being extracted from pouch 116. The magazine assembly is stored inverted—with base pad 46 resting in the upper position. The user grasps the base pad. The index finger 114 slides into forward relief 98 and this allows the user to rapidly know the magazine's orientation without having to look down. The user pulls the magazine free of the pouch while maintaining the positive engagement between the index finger and the forward relief 98.

Figure 16:
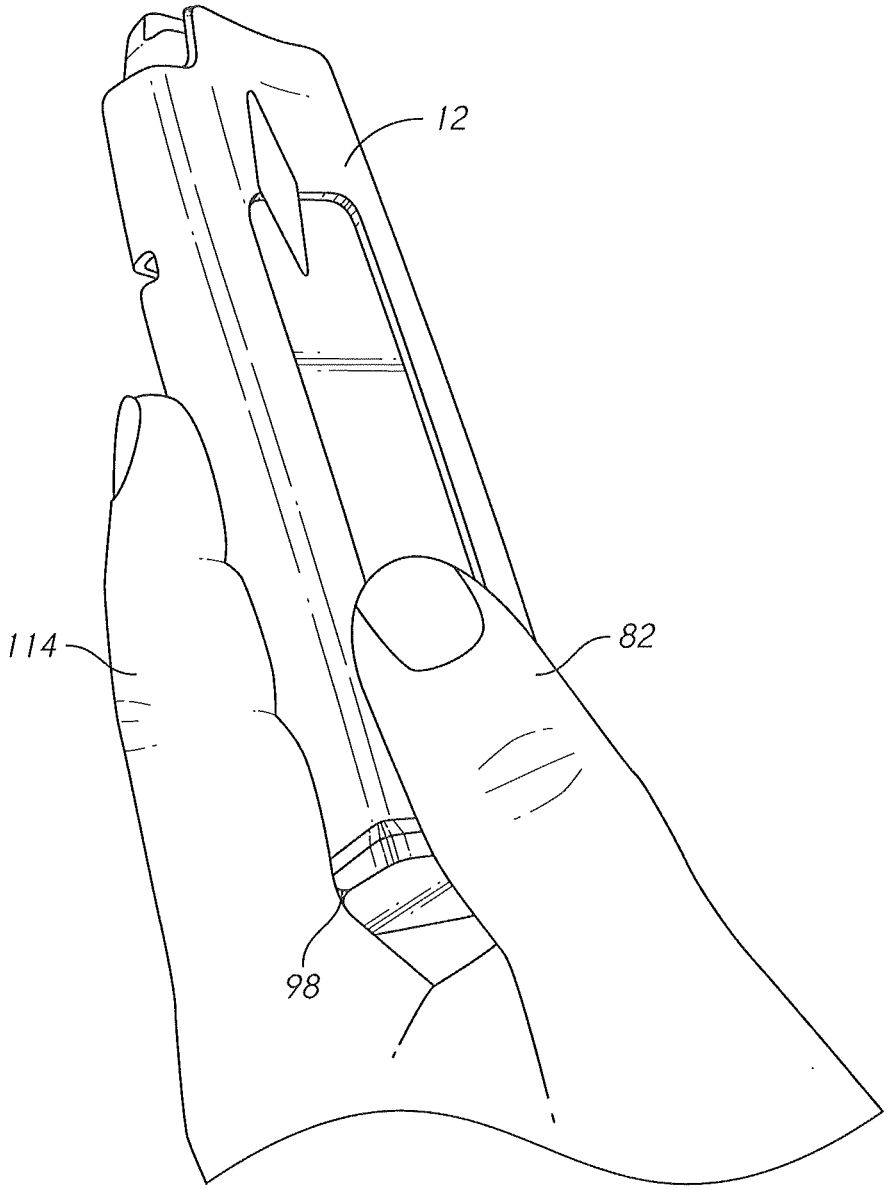
FIG. 16 is a perspective view, showing how a user can place the proximal portion of an index finger in the forward relief of the base pad in order to control the orientation of the base pad.

FIG. 16 shows the magazine after the user has pulled it free of the pouch and reoriented it prior to insertion in the firearm. The reader will note how left thumb 82 engages the side of the base pad and the side of the magazine tube. The left index finger 114 slides upward along the forward part of the magazine tube 12. However, the proximal portion of the index finger (nearest the palm) remains engaged with forward relief 98. This engagement provides positive orientation of the magazine while the thumb and other fingers laterally grip the base pad. The user can push the magazine up and into the magazine well in this orientation, with index finger 114 sliding upward on the outer surface of the forward portion of the pistol's grip.

Figure 13:
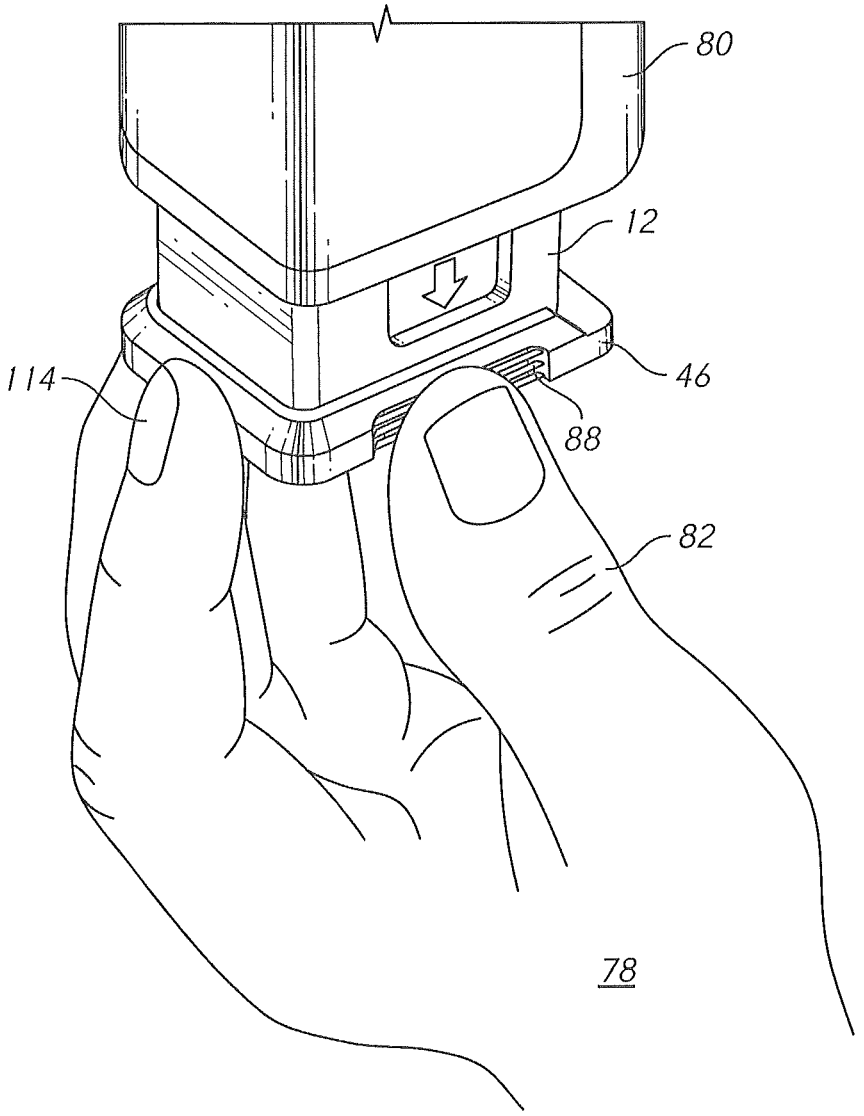
FIG. 13 is a perspective view, showing the placement of the index finger in the forward relief on the base pad.

FIG. 13 shows the operation of pulling an expended magazine assembly downward and out of pistol grip 80. The user may again place a portion of index finger 114 into forward relieve 98 (not visible) on base pad 46. This allows a positive orientation of the magazine even though the user is not looking at the magazine.

Many other variations on these embodiments will occur to those skilled in the art, including:

1. Integrally molding the base pad using a metal or a polymer;
2. Providing a different number of longitudinal ribs per side, such as two or four ribs per side;
3. Applying the grip enhancing features to more conventional (much taller) base pads; and
4. Applying the grip enhancing features to a base pad that is attached to the magazine tube by a non-sliding interface.

Although the preceding descriptions contain significant detail, they should not be construed as limiting the scope of the invention but rather as providing illustrations of the preferred embodiments of the invention. Those skilled in the art will know that many other variations are possible without departing from the scope of the invention. Accordingly, the scope of the invention should properly be determined with respect to the following claims rather than the examples given.

Having described my invention, I claim:

1. A firearm magazine, comprising:

(a) a tube having a front side, a right side, a left side, a rear side, and an open bottom;

(b) a left lateral flange extending from said left side of said tube proximate said open bottom;

(c) a right lateral flange extending from said right side of said tube proximate said open bottom;

(d) a base pad, including, (i) a floor surface closing said open bottom of said magazine tube, (ii) a left side with a left wall extending up from said floor surface, (iii) said left side including a left slot slidably engaged over said left lateral flange, (iv) a front with a front wall extending up from said floor surface, (v) a right side with a right side wall extending up from said floor surface, (vi) said right side including a right slot slidably engaged over said right lateral flange, (vii) a left inward sloping surface on said left side wall, (viii) a right inward sloping surface on said right side wall, (ix) a left side notch in said left side, (x) a right side notch in said right side, (xi) a lower surface, (xii) a forward relief extending from said lower surface into said front, (xiii) a left plurality of longitudinal ribs in said left side notch, (xiv) a right plurality of longitudinal ribs in said right side notch, (xv) said left plurality of longitudinal ribs lies below said left inward sloping surface, and (xvi) said right plurality of longitudinal ribs lies below said right inward sloping surface.

2. The firearm magazine as recited in claim 1, wherein:

(a) said left side notch extends into said left inward sloping surface; and (b) said right side notch extends into said right inward sloping surface.

3. The firearm magazine as recited in claim 1, wherein each of said longitudinal ribs includes an upper flat surface, a tip, and a lower sloped surface.

4. A firearm magazine, comprising:

(a) a tube having an open bottom;

(b) a base pad slidably engaged to said tube;

(c) said base pad having a floor surface positioned over said open bottom of said magazine tube;

(d) said base pad having a left side wall extending up from said floor surface, with a left inward sloping surface on said left side wall;

(e) said base pad having a right side wall extending up from said floor surface, with a right inward sloping surface on said right side wall;

(f) said base pad having a left side notch in said left side;

(g) said base pad having a right side notch in said right side;

(h) said base pad having a lower surface and a front;

(i) said base pad having a forward relief extending from said lower surface into said front;

(i) said base pad having a left plurality of longitudinal ribs in said left side notch;

(k) said base pad having a right plurality of longitudinal ribs in said right side notch;

(l) said left plurality of longitudinal ribs lying below said left inward sloping surface, and (m) said right plurality of longitudinal ribs lies below said right inward sloping surface.

5. The firearm magazine as recited in claim 4, wherein:

(a) said left side notch extends into said left inward sloping surface; and (b) said right side notch extends into said right inward sloping surface.

6. The firearm magazine as recited in claim 4, wherein each of said longitudinal ribs includes an upper flat surface, a tip, and a lower sloped surface.

7. A base pad for use in closing an open bottom on a firearm magazine, comprising:

(a) a floor surface positioned over said open bottom of said magazine tube;

(b) a left side wall extending up from said floor surface;

(c) a right side wall extending up from said floor surface;

(d) a left side notch in said left side;

(e) a right side notch in said right side;

(f) a lower surface;

(g) a front;

(h) a forward relief extending from said lower surface into said front;

(i) a left inward sloping surface on said left side wall;

(j) a right inward sloping surface on said right side wall;

(k) a left plurality of longitudinal ribs in said left side notch;

(l) a right plurality of longitudinal ribs in said right side notch;

(m) said left plurality of longitudinal ribs lying below said left inward sloping surface, and (n) said right plurality of longitudinal ribs lies below said right inward sloping surface.

8. The firearm magazine as recited in claim 7, wherein each of said longitudinal ribs includes an upper flat surface, a tip, and a lower sloped surface.

* * * * *